US008136494B2

(12) United States Patent
Atzwanger et al.

(10) Patent No.: US 8,136,494 B2
(45) Date of Patent: Mar. 20, 2012

(54) LIFTER GUIDE

(75) Inventors: Martin Atzwanger, Gleisdorf (AT); Emre Bulbul, Novi, MI (US); Michael Josef Fuchs, New Richmond, WI (US)

(73) Assignee: Ford Global Technologies, LLC, Dearborn, MI (US)

( * ) Notice: Subject to any disclaimer, the term of this patent is extended or adjusted under 35 U.S.C. 154(b) by 566 days.

(21) Appl. No.: 12/347,148

(22) Filed: Dec. 31, 2008

(65) Prior Publication Data

US 2010/0095916 A1 Apr. 22, 2010

Related U.S. Application Data

(60) Provisional application No. 61/107,308, filed on Oct. 21, 2008.

(51) Int. Cl.
*F01L 1/14* (2006.01)

(52) U.S. Cl. ..... 123/90.5; 123/90.48; 123/90.61

(58) Field of Classification Search ..... 123/90.5, 123/90.48, 90.61, 90.62, 90.64; 29/888.2
See application file for complete search history.

(56) References Cited

U.S. PATENT DOCUMENTS

| | | | | |
|---|---|---|---|---|
| 2,023,396 | A * | 12/1935 | Blomgren | 123/90.43 |
| 4,721,074 | A | 1/1988 | Wirth et al. | |
| 4,724,804 | A | 2/1988 | Wirth | |
| 5,088,455 | A | 2/1992 | Moretz | |
| 5,178,107 | A | 1/1993 | Morel, Jr. et al. | |
| 5,263,386 | A | 11/1993 | Campbell et al. | |
| 7,121,244 | B2 | 10/2006 | Roe et al. | |
| 7,275,507 | B2 | 10/2007 | Keller et al. | |
| 7,373,907 | B2 | 5/2008 | Balaraman et al. | |
| 2006/0272601 | A1 | 12/2006 | Balaraman et al. | |

* cited by examiner

*Primary Examiner* — Ching Chang
(74) *Attorney, Agent, or Firm* — O'Brien Jones PLLC; Fredrick Owens

(57) ABSTRACT

A guide for use in a vehicle engine having an engine block, cylinder head, and a cylinder head gasket. The guide comprises a valve lifter retention portion, a push rod retention portion in communication with the valve lifter retention portion via one or more apertures, and an alignment and attachment portion extending from the push rod retention portion and configured to be retained by contact with the cylinder head gasket.

18 Claims, 7 Drawing Sheets

LIFTER GUIDE

INTRODUCTION

This patent application claims priority to U.S. Provisional Patent Application No. 61/107,308, filed Oct. 21, 2008, the entire disclosure of which is incorporated by reference herein.

The present teachings relate to a guide for aligning push rods and valve lifters with in an engine. The present teachings also relate to a guide that is mounted in an engine using a locator portion that can be clamped between the engine block or cylinder head and the cylinder head gasket so that fasteners are not needed.

BACKGROUND

Internal combustion engines are known to utilize valve lifters, also referred to as tappets which engage a camshaft lobe at one end and a pushrod at the opposite end. Lash adjusters can be inserted between the lifter and the push rod to ensure an appropriate gap exists to accommodate heat expansion. Rollers can be utilized on the ends of the lifters that engage the camshaft lobe to reduce friction and extend the useful life of the lifter. Rollers should maintain a particular orientation with respect to the camshaft to prevent damage to the rollers and/or the engine.

Guides are known to be used for aligning valve lifters and maintaining the lifter rollers in a correct orientation for engine assembly or maintenance requiring lifter removal and replacement. Such guides can be time-consuming and complicated to install. Guides can also be expensive to manufacture and can produce undesirable engine noise.

It is therefore desirable to provide a guide that is inexpensive to produce and can be quickly and simply installed. It is also desirable for that guide to align valve lifters with respective camshaft lobes for installation, and additionally align push rods with respective valve lifters (and, in some instances, respective lash adjusters) for installation. It is desirable to be able to install at least the lifters into the guide prior to installing the guide in a vehicle engine. It is also desirable to provide a lifter guide that does not produce undesirable engine noise.

SUMMARY

The present teachings provide a guide for use in a vehicle engine having an engine block, a cylinder head, and a cylinder head gasket. The guide comprises a valve lifter retention portion, a push rod retention portion in communication with the valve lifter retention portion via one or more apertures, and an alignment and attachment portion extending from the push rod retention portion and configured to be retained by contact with the vehicle cylinder head gasket.

The present teachings also provide a guide for use in a vehicle engine having an engine block, a cylinder head, and a cylinder head gasket. The guide comprises a valve lifter retention portion and a push rod retention portion in communication with the valve lifter retention portion via one or more apertures. The push rod retention portion comprises a front wall having a first height and a rear wall having a second height, the second height being greater than the first height and providing a surface to guide the push rods in the push rod retention portion for assembly or maintenance of the vehicle engine.

The present teachings further provide a method for assembling or repairing a vehicle engine. The method comprises inserting valve lifters into a valve lifter retention portion of a guide, aligning the guide in the vehicle engine so that the valve lifters are aligned with respective camshaft lobes, retaining the guide with a cylinder head gasket, and inserting push rods into a push rod retention portion of the guide.

Additional objects and advantages of the present teachings will be set forth in part in the description which follows, and in part will be obvious from the description, or may be learned by practice of the present teachings. The objects and advantages of the present teachings will be realized and attained by means of the elements and combinations particularly pointed out in the appended claims.

It is to be understood that both the foregoing general description and the following detailed description are exemplary and explanatory only and are not restrictive of the present teachings, as claimed.

The accompanying drawings, which are incorporated in and constitute a part of this specification, illustrate exemplary embodiments of the present teachings and together with the description, serve to explain the principles of the present teachings.

DESCRIPTION OF THE EMBODIMENTS

Reference will now be made in detail to exemplary embodiments of the present teachings, such exemplary embodiments being illustrated in the accompanying drawings. Wherever possible, the same reference numbers will be used throughout the drawings to refer to the same or like parts.

Figure 1:
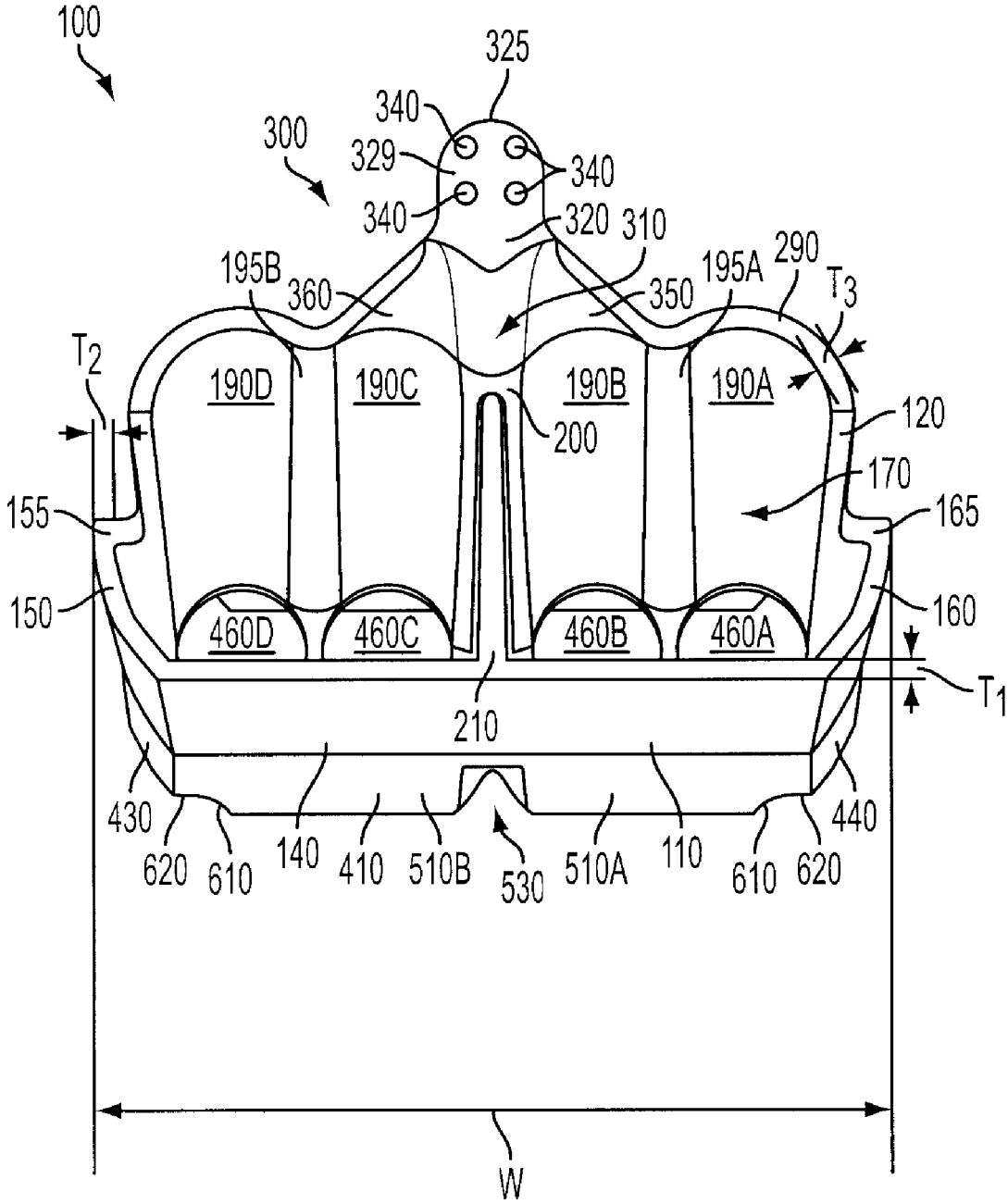
FIG. 1 is a top perspective view of an exemplary embodiment of a guide in accordance with the present teachings.
Figure 2:
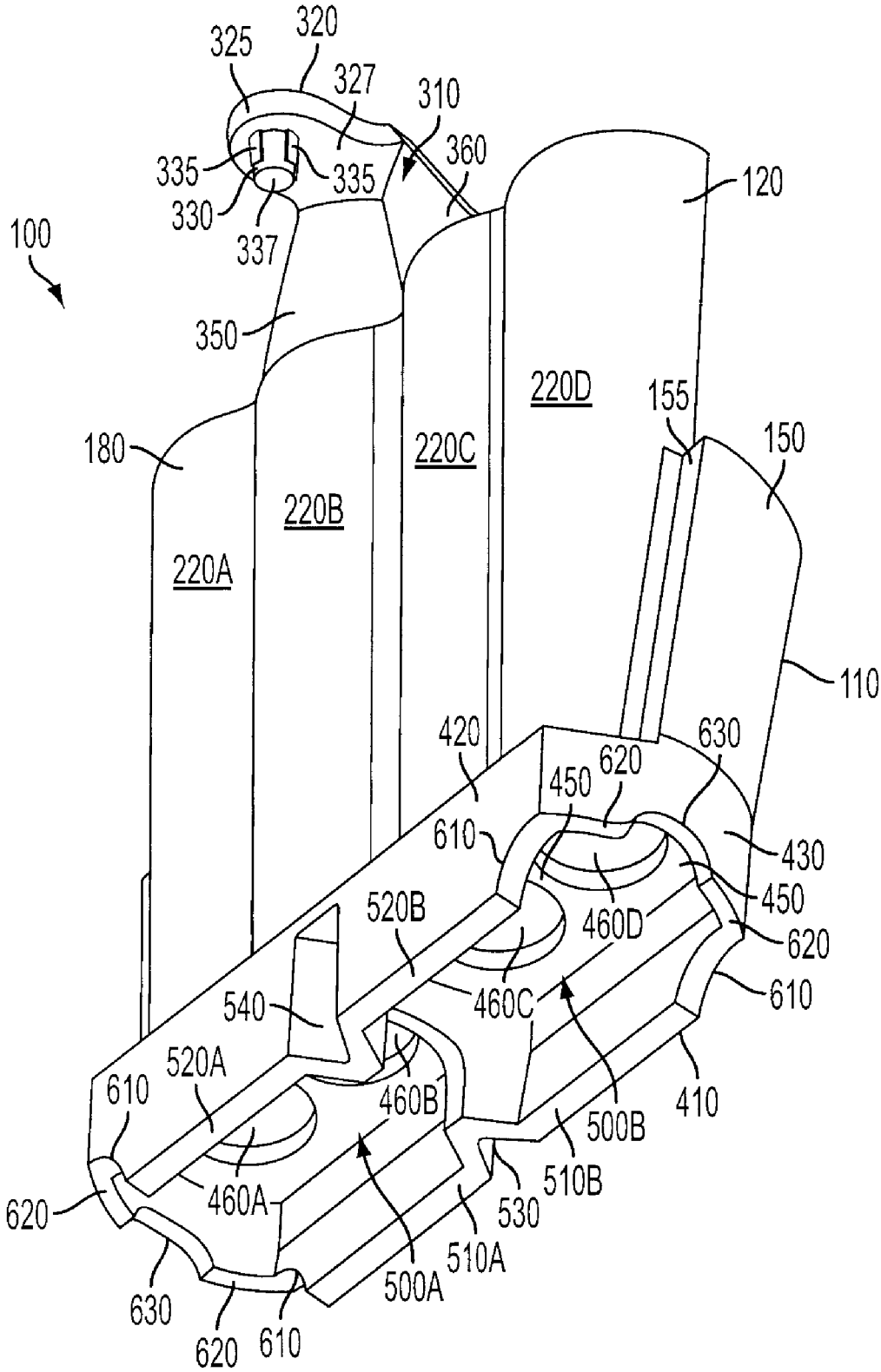
FIG. 2 is a rear bottom perspective view of the embodiment of FIG. 1.
Figure 3:
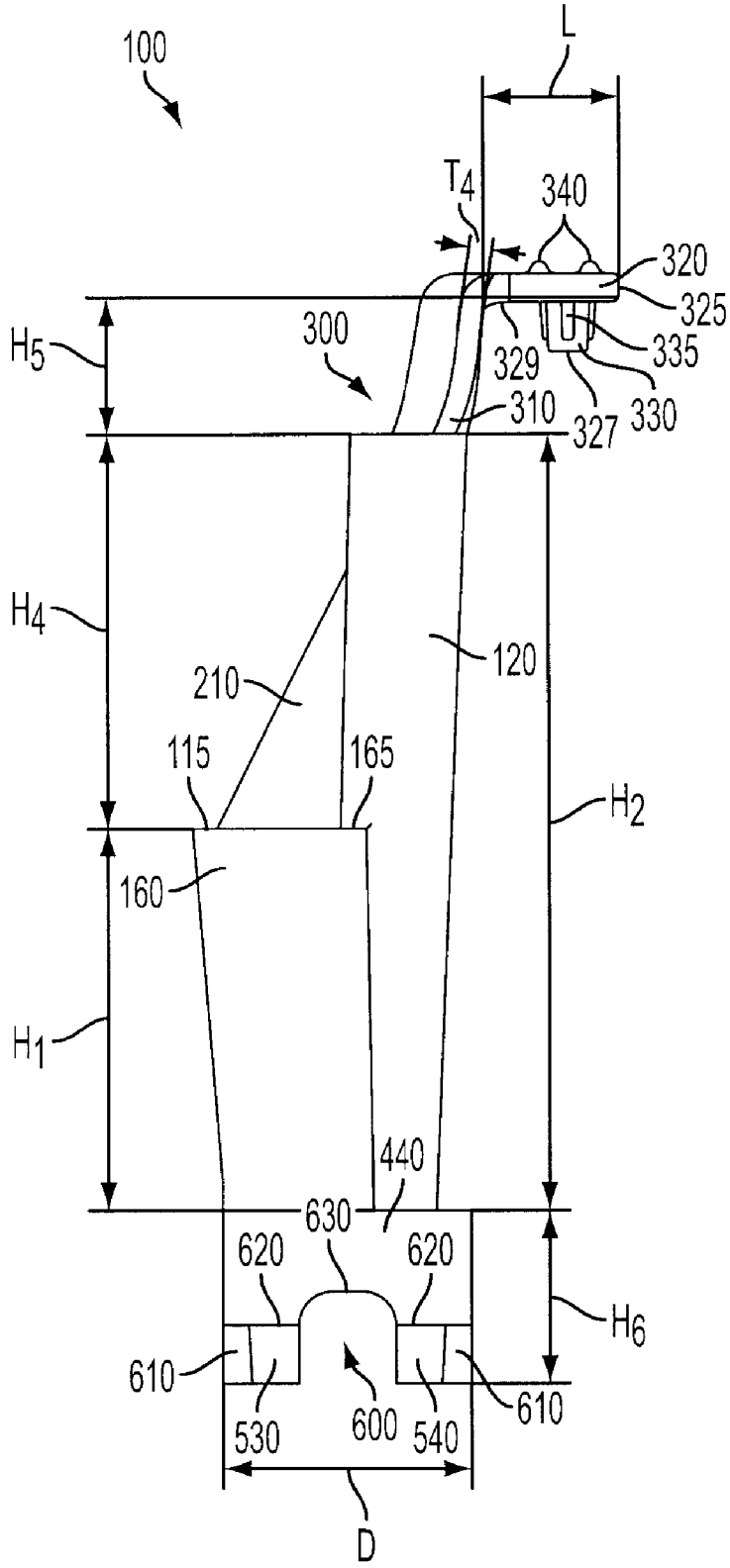
FIG. 3 is a side view of the embodiment of FIG. 1.

FIGS. 1-3 illustrate an exemplary embodiment of a guide in accordance with the present teachings. The guide 100 includes a front wall 110 and a rear wall 120. As shown in FIG. 3, the front wall 110 has a height $H_1$ and the rear wall 120 has a height $H_2$ that is greater than the height $H_1$ of the front wall 110. The front wall 110 has an inner surface (not shown) and an outer surface 140. In the illustrated embodiment, the outer surface 140 of the front wall 110 is substantially flat and planar. The front wall 110 has a thickness $T_1$ that can be substantially constant. In certain embodiments, the thickness $T_1$ can be, for example, about two or three millimeters.

Side walls 150, 160 and flanged portions 155, 165 can extend between the front wall 110 and the rear wall 120 of the guide 100. The side walls 150, 160 can curve outwardly as they move from the front wall 100 rearwardly toward the rear wall 120. In certain embodiments, the side walls 150, 160 can flare outwardly with a draft angle facilitating removal of the guide from a mold used to form the guide. In the illustrated embodiment, the side walls 150, 160 curve outwardly until they are substantially aligned with the rear wall 120, and then are connected with the rear wall 210 via flanged portions 155, 165. In certain embodiments, the side walls have a thickness $T_2$ that is substantially the same as the thickness $T_1$ of the front wall 110.

The rear wall 120 comprises an inner surface 170 and an outer surface 180. As shown, the inner surface 170 of the rear wall 120 comprises arcuate alignment chutes 190A, 190B, 190C, and 190D that each assist in aligning a push rod with a respective lifter (and, in some instances, a respective lash adjuster) that is held in a base portion of the guide 100 as described below. The arcuate alignment chutes 190A, 190B, 190C, and 190D together form a push rod retention portion of the guide 100, which can provide a surface to guide the push rods for assembly or maintenance of the vehicle engine. The push rod retention portion of the guide 100 also assists in aligning the push rods with respective rocker arms. Although four arcuate alignment chutes are shown in the illustrated embodiment, one skilled in the art will understand that a vehicle engine may require more or less chutes, and therefore any number of chutes is contemplate by the present teachings.

In various embodiments, the arcuate alignment chutes 190A and 190B are separated by a ridge 195A. Similarly, the arcuate alignment chutes 190C and 190D are separated by a ridge 195B. In certain embodiments, a dividing wall 200 separates the arcuate alignment chutes 190B and 190C. The dividing wall 200 can promote good material fill in embodiments where the guide is molded, and additionally can control the location of "knit" lines and provide structural stiffness and stability. The dividing wall 200 may include a strengthening member 210, which further serves the purposes of dividing wall 200. In the illustrated embodiment, the strengthening member 210 is substantially triangular, which provides suitable structural stiffness and stability while minimizing the amount of material needed for, and dimensions of, the guide. The strengthening member 210 extends from the dividing wall 200 forward to align with a top portion 115 of the front wall 110.

In the illustrated exemplary embodiment, the outer surface 180 of the rear wall 120 has a shape that is complementary to the shape of the inner surface 170, because a thickness $T_3$ of the rear wall is substantially constant. As shown in FIG. 2, the rear wall 180 of the illustrated exemplary embodiment therefore comprises four arcuate portions 220A, 220B, 220C, and 220D. Because the height $H_2$ of the rear wall 120 is greater than the height $H_1$ of the front wall 110 in the illustrated exemplary embodiment, the rear wall 120 is not joined with the front wall 110 over a portion of the guide 100 having a height $H_4$(see FIG. 3). Indeed, no side walls are present through height $H_4$. In certain embodiments, rear wall thickness $T_3$ can be substantially the same as thicknesses $T_1$ and $T_2$. The outer surface 180 of the rear wall 120 need not have a shape that is complementary to the shape of the inner surface 170, because the thickness $T_3$ of the rear wall need not be substantially constant.

The height $H_1$ of the front wall 110 can be determined by balancing a need for clearance to the cylinder head when the engine is assembled, and providing a suitable enclosure for the hydraulic lash adjusters, so that the adjusters do not fall into the engine. In certain embodiments, the lifter guide is designed to allow removal of individual hydraulic lash adjusters using a magnet inserted through the apertures 460A 460B, 460C, and 460D (described below) without removing the cylinder head.

In the illustrated exemplary embodiment, above the rear wall 120 and extending therefrom is an alignment and attachment portion 300 of the guide 100. In certain embodiments of the present teachings, the alignment and attachment portion 300 includes a substantially vertical portion 310, a substantially horizontal portion 320, a locator protrusion 330, and one or more retention protrusions 340. In the illustrated exemplary embodiment, the substantially vertical portion 310 of the alignment and attachment portion 300 extends from a top surface 290 of the rear wall 120. As shown in the embodiment of FIGS. 1-3, the vertical portion 310 can include two arcuate halves 350, 360 that taper from a widest portion where they meet the top surface 290 of the rear wall 120 to a narrowest portion where they meet the substantially horizontal portion 320. In various embodiments, the substantially vertical portion 310 and the substantially horizontal portion 320 of the alignment and attachment portion 300 can have a thickness $T_4$ that is substantially the same as thicknesses $T_1$, $T_2$, and/or $T_3$.

Figure 4:
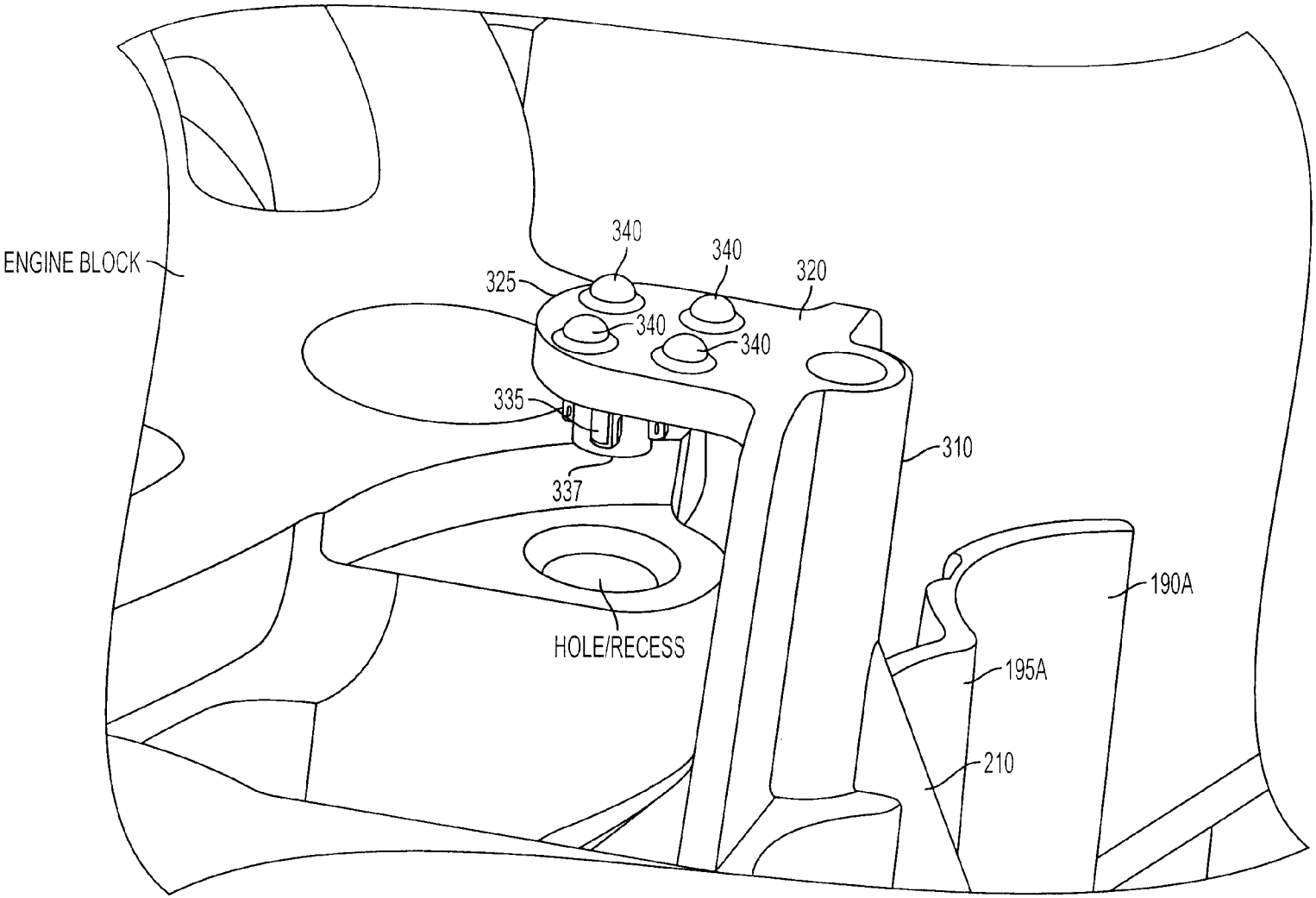
FIG. 4 illustrates an exemplary embodiment of a lifter guide prior to assembly in an engine.
Figure 5:
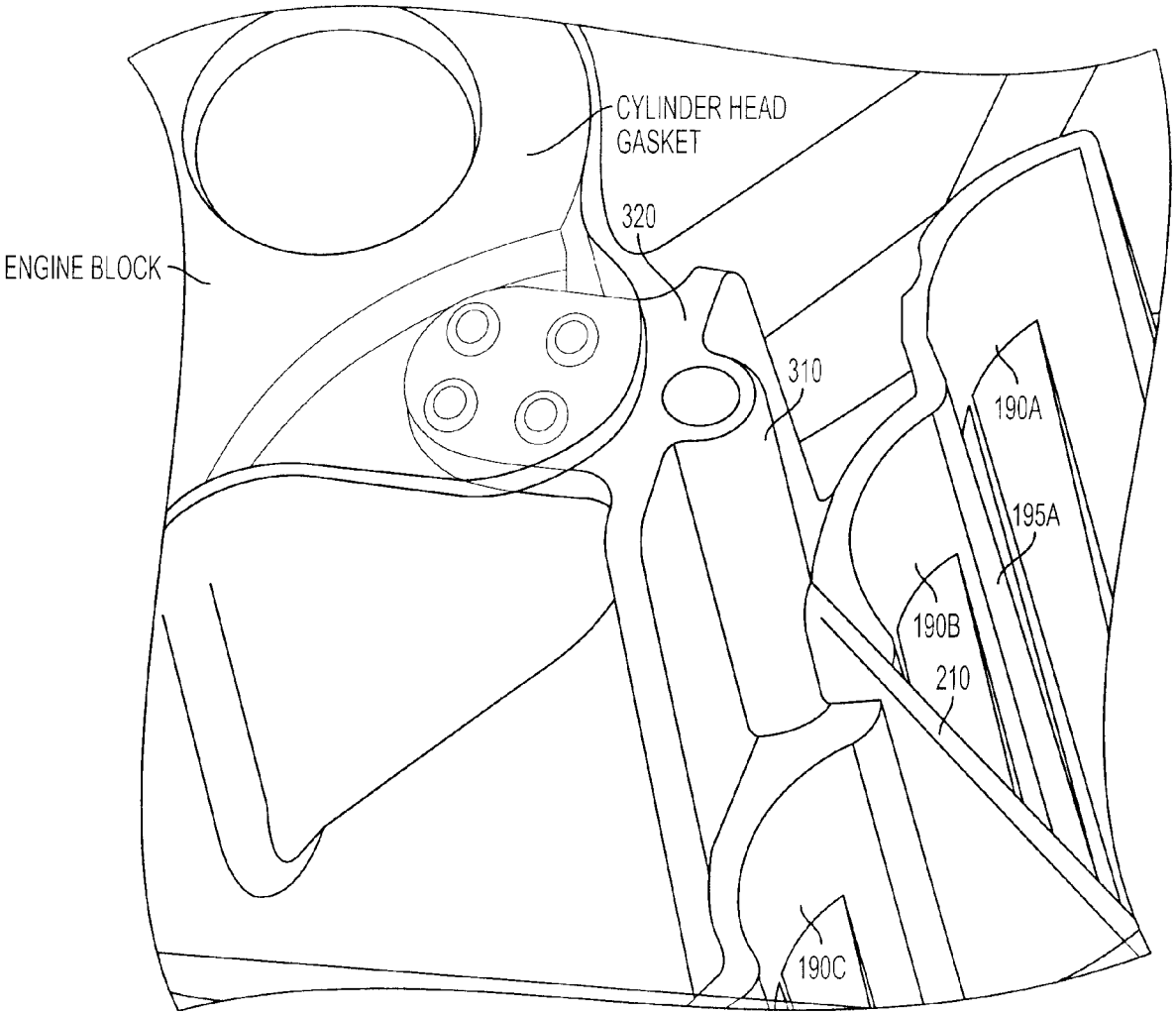
FIG. 5 illustrates an exemplary embodiment of the lifter guide embodiment of FIG. 4 assembled in an engine.

The substantially horizontal portion 320 has a length L enabling it to be suitably clamped between the engine block (see FIGS. 4-7) or cylinder head (not shown) and the cylinder head gasket (see FIG. 5). In certain embodiments, the length L can be dictated by engine block geometry in terms of where the bosses can be cast around a hole or recess into which the protrusion 330 is inserted. An exemplary hole/recess is illustrated in FIG. 4. In the illustrated embodiment, the distal end 325 of the substantially horizontal portion 320 is rounded. However, one skilled in the art will appreciate that a variety of shapes can be utilized for the distal end 325 of the substantially horizontal portion 320 (e.g., squared) and indeed for the substantially horizontal portion 320 itself and the substantially vertical portion 310.

In various embodiments of the present teachings, a locator protrusion 330 extends downwardly from a bottom surface 327 of the substantially horizontal portion 320. In certain embodiments, the locator protrusion 330 can include ridges 335 extending radially outwardly therefrom. In the illustrated exemplary embodiment, four evenly-spaced ridges 335 are shown, which extend from where the locator protrusion 330 meets the bottom surface 327 of the substantially horizontal portion 320 more than half way toward a distal end 337 of the locator protrusion. In certain embodiments, the number of ridges is chosen based on the size of the major diameter of the locator protrusion 330, and also known balancing considerations for composition of the guide and protrusions, ease of installation (push-in force), ease of locating, and the need for the protrusions to remain intact to some extent for repeat installations (for example, protrusions that are too small may be scraped off during a first installation of the guide). In accordance with certain embodiments of the present teachings, when installing the guide 100 in a vehicle engine, the locator protrusion 330 can be inserted in a hole or recess (see FIG. 4) that is drilled or otherwise formed in the vehicle, for example in a portion of the engine block. The ridges 335, if provided, can assist in maintaining frictional engagement when the locator protrusion 330 is inserted in the hole or recess.

One skilled in the art will understand that the locator protrusion and corresponding hole or recess can have a variety of configurations within the scope of the present teachings. For example, the locator protrusion need not have a circular cross section. It can have, for example, a square, oval, triangular or other cross section. The hole into which the locator protrusion is inserted need not have exactly the same shape as the locator protrusion's cross section. It can have any size and shape that accommodates insertion and a suitable degree of retention of the locator protrusion. Further, in various embodiments not illustrated herein, the locator protrusion can extend substantially horizontally from the attachment portion 300 or from the rear wall 120 to engage a complementary horizontally-extending hole or recess in the engine block, or can extend substantially vertically in an upward direction from the attachment portion 300 or from the rear wall 120 to engage a complementary hole or recess in a cylinder head.

Utilizing an alignment and attachment portion such as the alignment and attachment portion 300 illustrated in the exemplary embodiments facilitates proper location and retention of the guide in a vehicle engine without the need for fasteners such as those typically used in existing guides (e.g., screws). Engine assembly can therefore be made simpler, more efficient, and less expensive.

In the illustrated exemplary embodiments, retention protrusions 340 are located on a top surface 329 of the substantially horizontal portion 320. The retention protrusions 340 can be provided to enhance frictional engagement of the substantially horizontal portion 320 with the cylinder head gasket when the substantially horizontal portion 320 is clamped between the engine block and the cylinder head gasket. One skilled in the art will appreciate that a variety of numbers, locations, and/or shapes of retention protrusions can be provided. Indeed, the present teachings contemplate no retention protrusions at all.

In certain embodiments of the present teachings, the base portion is located at a bottom portion of (e.g., below the front wall 110 and the rear wall 120 of) the lifter guide 100. The base portion includes a front wall 410, a rear wall 420, side walls 430, 440, and a top wall 450. Apertures 460A, 460B, 460C, and 460D extend through the top wall 450 of the base portion. Valve lifters and rollers thereon can be held by the base portion, and the apertures 460A, 460B, 460C, and 460D allow the valve lifters to communicate with and/or be connected with respective push rods accommodated in the arcuate alignment chutes 190A, 190B, 190C, and 190D. In certain embodiments, the base portion of the lifter guide 100 retains the lifters at a correct orientation with respect to respective camshaft lobes.

In accordance with various embodiments of the present teachings, the base portion can retain the valve lifters using a structure similar to that set forth in U.S. Pat. No. 5,088,455, the entire disclosure of which is incorporated herein by reference. In certain embodiments, the base portion of the guide 100 can comprise two "sockets" 500A and 500B, each of which holds two valve lifters. The sockets 500A, 500B form a lifter retention portion of the guide 100. In the illustrated exemplary embodiment, socket 500A is defined by a portion 510A of the front wall 410 of the base portion, a portion 520A of the rear wall 420 of the base portion, side wall 440, and a respective portion of recessed portions 530, 540 that separate the sockets 500A and 500B from each other. Recessed portions 530, 540 can be located substantially midway along each of the front wall 410 and the rear wall 420. Socket 500B is defined by a portion 510B of the front wall 410 of the base portion, a portion 520B of the rear wall 420 of the base portion, side wall 430, and a respective portion of recessed portions 530, 540 that separate the sockets 500A and 500B from each other.

In the illustrated exemplary embodiments, each of the side walls 430, 440 of the base portion include cutout portions 600 defined by, for example, substantially vertical portions 610, substantially horizontal portions 620, and arched portions 630. The cutout portions 600 can provide a material savings for the guide 100.

In certain embodiments of the present teachings, the height $H_2$ of the rear wall 120 can be selected to span a substantial portion of the distance between the engine head gasket and the portion of the engine block along which the guide extends. This span can be seen in FIGS. 6 and 7. Generally, the remainder of the distance between the engine head gasket and the engine block that must be spanned by the guide includes the height $H_5$ of the alignment and attachment portion 300 and the height $H_6$ of the base portion. The overall width W and depth D of the guide can be selected to accommodate engine dimensions and the number of push rods and valve lifters accommodated. In the illustrated exemplary embodiment, the guide 100 accommodates one cylinder of a vehicle, each cylinder having an associated pair of push rods and respective valve lifters. The present teachings therefore contemplate that, for example, eight of the illustrated guides 100 would be utilized for an 8-cylinder engine.

FIG. 4 shows an exemplary embodiment of a guide 100 having its locator protrusion 330 positioned above a complementary hole/recess in an engine block. In FIG. 5, the locator protrusion 330 has been inserted into the hole/recess and a cylinder head gasket covers the horizontal portion 320 of the attachment portion 300 to hold the guide 100 in position.

Figure 6:
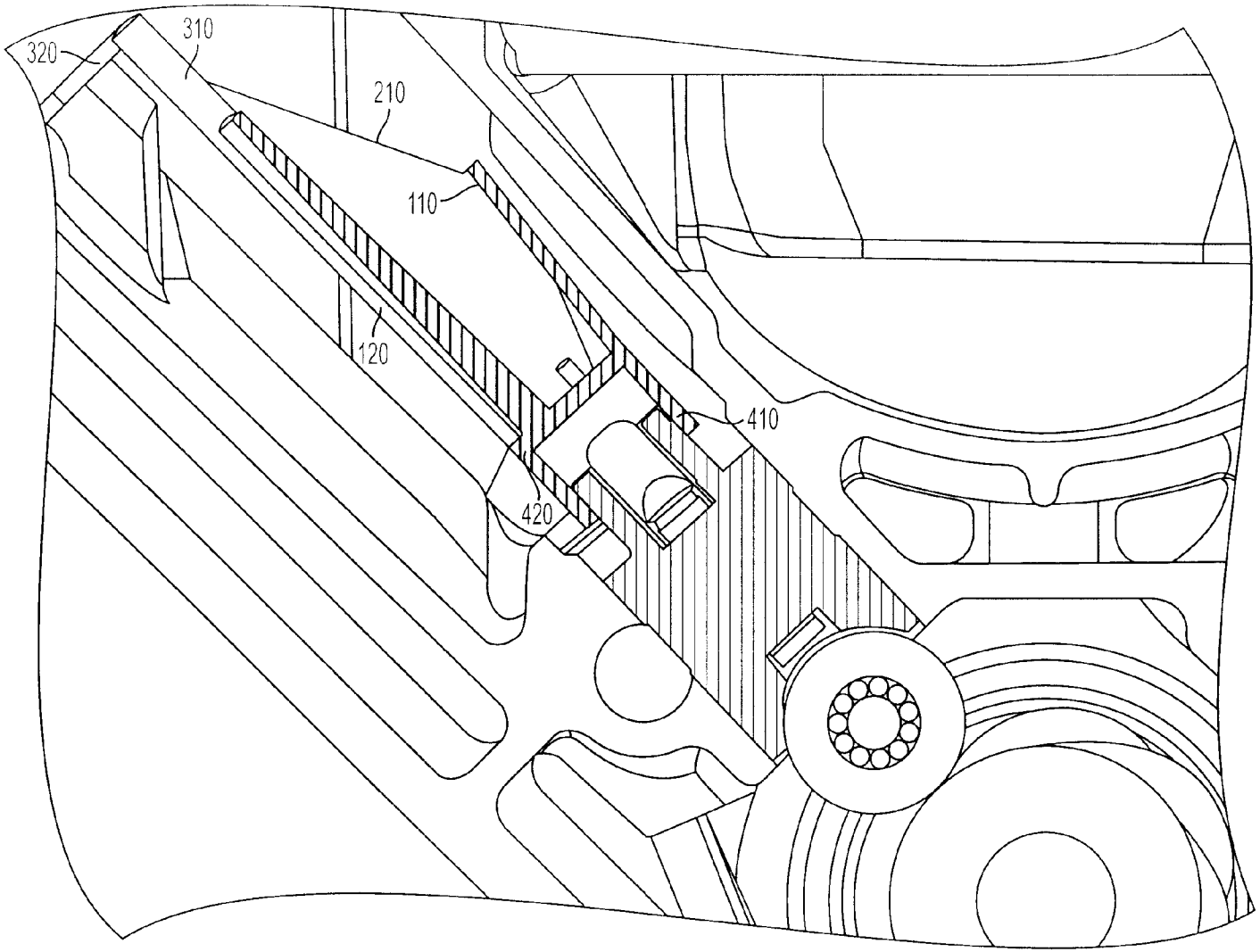
FIG. 6 is a cross section through an engine with the lifter guide embodiment of FIG. 4 assembled in the engine.
Figure 7:
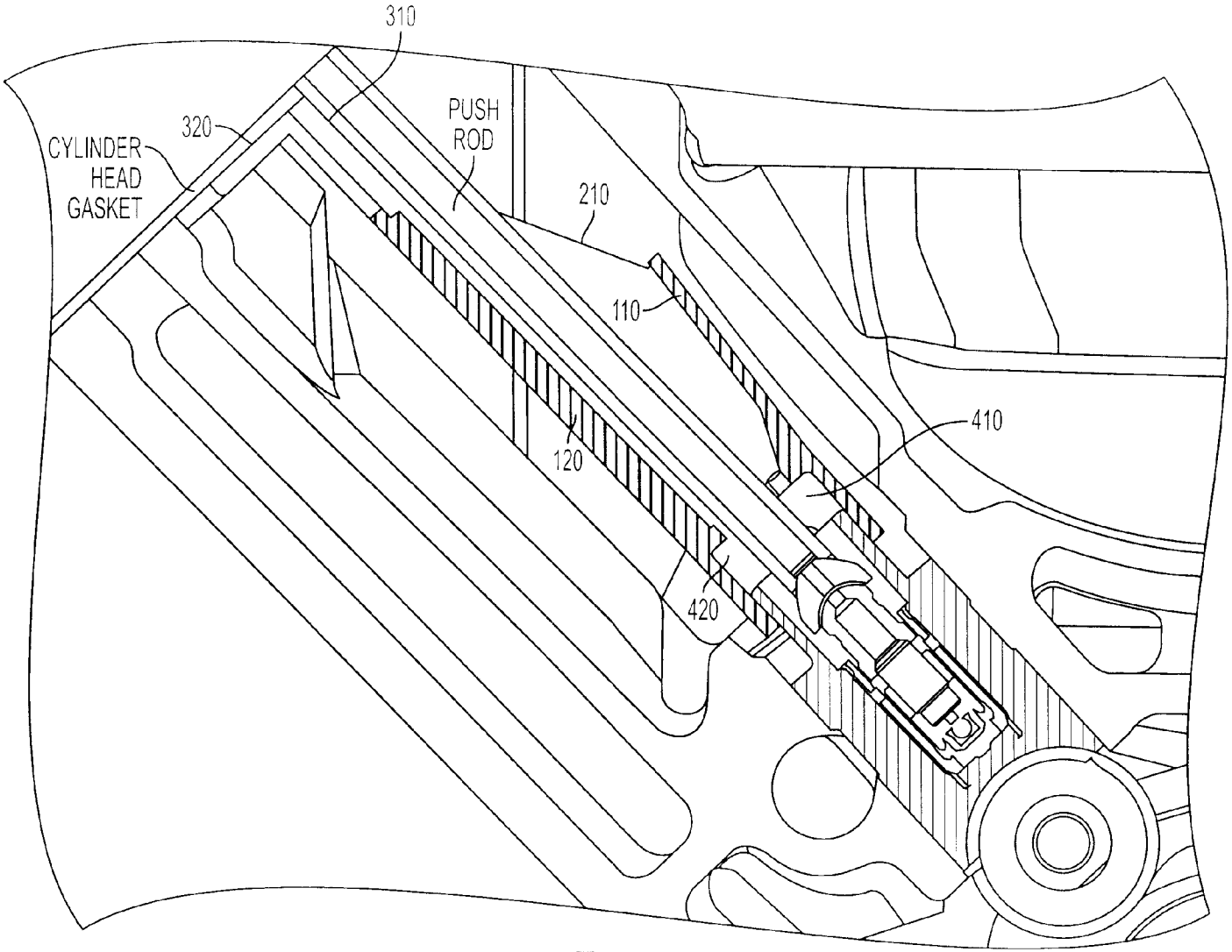
FIG. 7 is a cross section through an engine with the lifter guide embodiment of FIG. 4 assembled therein, along with aligned push rods and lifters.

FIG. 6 is a cross section of a guide embodiment 100 properly mounted in an engine, extending along the engine block from the cylinder head gasket to the camshaft access apertures. FIG. 7 is also a cross section of the guide embodiment 100 properly mounted in an engine, with the push rods, lash adjusters, and valve lifters inserted and aligned.

A guide 100 in accordance with the present teachings can be manufactured in a number of know ways, for example by molding. In certain embodiments, molding using glass reinforced plastic (GRP) can be utilized. The present teachings contemplate the guide comprising other materials such as, for example, other plastics suitable for use in vehicle engines.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A guide for use in a vehicle engine having an engine block, cylinder head, and a cylinder head gasket, the guide comprising:

a valve lifter retention portion;

a push rod retention portion in communication with the valve lifter retention portion via one or more apertures; and an alignment and attachment portion extending from the push rod retention portion and configured to be retained by contact with the cylinder head gasket, wherein the push rod retention portion comprises a front wall having a first height and a rear wall having a second height, the second height being greater than the first height.

2. The guide of claim 1, wherein the valve lifter retention portion comprises two sockets.

3. The guide of claim 1, wherein the valve lifter retention portion is configured to align one or more valve lifters and retain the valve lifters in a proper orientation.

4. The guide of claim 1, wherein the rear wall of the push rod retention portion provides a surface to guide the push rods for assembly or maintenance of the vehicle engine.

5. A guide for use in a vehicle engine having an engine block, cylinder head, and a cylinder head gasket, the guide comprising:

a valve lifter retention portion;

a push rod retention portion in communication with the valve lifter retention portion via one or more apertures; and an alignment and attachment portion extending from the push rod retention portion and configured to be retained by contact with the cylinder head gasket, and comprising a vertical portion, a horizontal portion, and a locator protrusion.

6. The guide of claim 5, wherein the locator protrusion is configured to engage a hole or recess in the vehicle engine to properly align the guide and therefore the valve lifters in the vehicle engine.

7. The guide of claim 6, wherein the locator protrusion comprises radially-outwardly extending ribs.

8. The guide of claim 5, wherein the alignment and attachment portion further comprises one or more retention protrusions.

9. A guide for use in a vehicle engine having an engine block, a cylinder head, and a cylinder head gasket, the guide comprising:

a valve lifter retention portion; and a push rod retention portion in communication with the valve lifter retention portion via one or more apertures, the push rod retention portion comprising a front wall having a first height and a rear wall having a second height, the second height being greater than the first height and providing a surface to guide the push rods in the push rod retention portion for assembly or maintenance of the vehicle engine.

10. The guide of claim 9, wherein the engine block comprises valve lifter apertures and the push rod retention portion of the guide extends at least about one half of a distance between the cylinder head gasket and the valve lifter apertures.

11. The guide of claim 9, the valve lifter retention portion comprises a front wall, a rear wall, side walls, a top wall, and recessed portions located substantially midway along each of the front wall and the rear wall.

12. The guide of claim 11, wherein each of the valve lifter retention portion side walls comprises a cutout portion.

13. The guide of claim 9, further comprising an alignment and attachment portion extending from the push rod retention portion and configured to be retained by engagement with the cylinder head gasket.

14. The guide of claim 13, wherein the alignment and attachment portion comprises a vertical portion, a horizontal portion, and a locator protrusion.

15. The guide of claim 14, wherein the locator protrusion is configured to engage a hole or recess in the vehicle engine to properly align the guide and therefore the valve lifters in the vehicle engine.

16. The guide of claim 14, wherein the locator protrusion comprises radially-outwardly extending ribs.

17. The guide of claim 13, wherein the alignment and attachment portion further comprises one or more retention protrusions.

18. The guide of claim 9, wherein the push rod retention portion comprises one or more arcuate alignment chutes.

* * * * *